US005381211A

United States Patent [19]

Godlove

[11] Patent Number: 5,381,211

[45] Date of Patent: Jan. 10, 1995

[54] TEXTURING OF OVERCOATED IMAGING MEMBER FOR CLEANING

[75] Inventor: Ronald E. Godlove, Bergen, N.Y.

[73] Assignee: Xerox Corporation, Stamford, Conn.

[21] Appl. No.: 65,051

[22] Filed: May 24, 1993

[51] Int. Cl.[6] ..... G03G 5/00

[52] U.S. Cl. ..... 355/211; 430/56; 430/127; 430/132; 355/299

[58] Field of Search ..... 355/211, 212, 299; 430/56, 84–85, 127–128, 132, 133; 492/18, 25, 28, 30

[56] References Cited

U.S. PATENT DOCUMENTS 3,992,091 11/1976 Fisher .
4,076,564 2/1978 Fisher .
4,134,763 1/1979 Fujimura et al. .
4,537,849 8/1985 Arai .
4,551,406 11/1985 Schaedlich et al. ..... 430/56 X
4,693,951 9/1987 Takasu et al. .
4,764,448 8/1988 Yoshitomi et al. .
4,804,607 2/1989 Atsumi .
4,904,557 2/1990 Kubo .
4,933,247 6/1990 Osawa et al. ..... 430/128 X
5,162,183 11/1992 Lindblad et al. ..... 430/132 X
5,187,039 2/1993 Meyer .
5,252,418 10/1993 Ishikawa et al. ..... 355/211 X
5,296,895 3/1994 Naito ..... 355/211 X

FOREIGN PATENT DOCUMENTS 02-187784 7/1990 Japan .

*Primary Examiner*—Matthew S. Smith
*Attorney, Agent, or Firm*—Oliff & Berridge

[57] ABSTRACT

A method and apparatus is provided for cleaning residual toner and paper fiber residue from an electrophotographic imaging member using an elastomeric cleaning blade. Reduced friction between the blade and the imaging member and enhanced cleaning without degrading image reproduction quality results from appropriate texturing of the imaging member. The texturing is impressed upon an overcoat layer formed on the photosensitive layer of the imaging member such that a uniform pattern of at least 20 very fine parallel grooves per centimeter are disposed parallel to the direction of process movement and extend along the entire circumference of the imaging member. The very fine parallel grooves have a depth and lateral width sufficiently shallow/narrow to prevent individual particles of toner material from lodging in the grooves and also to ensure copy quality is not degraded.

7 Claims, 2 Drawing Sheets

TEXTURING OF OVERCOATED IMAGING MEMBER FOR CLEANING

BACKGROUND OF THE INVENTION

1. Field of the Invention

This invention relates to an electrophotographic image forming apparatus, and more particularly to a textured photoreceptor (i.e., imaging member) with very fine parallel grooves formed laterally upon the overcoat layer of the imaging member to reduce cleaning blade wear by reducing the adhesion between the cleaning blade and the overcoat layer of the imaging member without degrading image reproduction quality.

2. Description of Related Art

In electrophotography, an Imaging member, either belt or drum, containing an insulating layer on a conductive layer is imaged by first uniformly electrostatically charging its surface. The insulating layer is then exposed to a pattern of activating electromagnetic radiation such as light. The radiation selectively dissipates the charge in certain areas of the insulating layer while leaving behind an electrostatic latent image in the other areas. This electrostatic latent image may then be developed to form a visible image by depositing finely divided electroscopic marking particles (i.e., toner) on the surface of the insulating layer. The resulting visible image may then be transferred from the imaging member to a support, such as paper. This imaging process may be repeated many times with reusable insulating layers. It is necessary to clean residual toner from the surface of the insulating layer prior to repeating another imaging cycle, however.

One common method of cleaning is blade cleaning. Elastomeric blade cleaning of imaging members is conceptually simple and economical, but raises reliability concerns in mid and high volume applications due to apparent random failures. Such random failures justify the reluctance to include blade cleaners in higher volume machines with or without some backup cleaning element.

A number of methods have been proposed to enhance blade/imaging member contact properties. One method includes agitation of the blade against the imaging member to prevent build-up of material along the contact seal. Another method includes addition of redundant members, such as disturber brushes to loosen or collect debris which might otherwise stress the blade element. These methods increase the mechanical complexity and the cost of the cleaning assembly, and are thus undesirable.

Another method for enhancing blade/imaging member contact properties includes the addition of lubricants to the toner, imaging member and/or blade. However, this method increases the material complexity and introduces compatibility problems. This often results in films developing on the imaging member which hinder imaging member function and degrade image quality.

A further proposal for enhancing blade/imaging member contact properties is by roughening the imaging member surface to reduce the blade friction and the blade/imaging member contact area. This method may also introduce compatibility problems depending on how the roughened surface is introduced. For example, particulate additives to the bulk of the transport layer to provide roughness through surface asperities can degrade electrical and/or mechanical properties. Surface asperities can be worn away in normal machine copying, limiting any cleaning benefit. Surface roughening can also have direct adverse effects such as the introduction of sites against which toner may become lodged. Imaging member surface roughening can also inhibit cleaning by allowing the blade to pass over toner and other surface debris.

One of the most common "predictable" or non-random blade cleaning failures is permanent impaction of toner particles and toner fragments. This type of failure is generally encountered and resolved during program development. It involves material, including toner particles, which becomes impacted onto the imaging surface and adheres with such force that the material cannot be removed by the cleaning elements. Additionally debris, including untransferred toner residue and developer and/or toner additives, may become jammed against an asperity on the imaging member surface. Repeated passes and extended copying can lead to the build-up of an elongated crusty deposit in front of the asperity which eventually print out as spots on the copy.

Various strategies have been implemented or proposed to deal with this type of blade cleaning problem, including those enumerated above. Additional approaches to the resolution of such problems include the elimination of the material which impacts or builds-up in the tail, the inclusion of additives which lubricate and/or scavenge the offending material, and the development of an imaging surface which resists toner impaction and/or build-up.

Optimally, all residual toner is being totally removed by the cleaning blade with each rotation of the imaging member drum or belt surface. The entire surface must be thoroughly cleaned thousands of times without damage. The cleaning loads on the blade are necessarily uneven, both short term and long term, because the location, density and tenacity of the residual toner varies widely over the surface, depending on the images, exposures, surface charge, toner development and image location. The required frictional/adhesional forces for effective blade cleaning have been high, particularly for the desired combination of a relatively soft elastomeric blade cleaning tip edge tightly engaging an imaging member surface, which imaging member surface must be smooth enough to provide high optical resolution images. Unless carefully controlled, these adhesional forces can also result in the generation of excessive pressure or heat, resulting in physical and chemical changes in the toner, smearing of toner materials onto the imaging member or blade, excessive imaging member or blade wear, or other problems, especially in higher speed machines. Thus, cleaning dry toner from an imaging member presents extremely critical requirements not normally found in other cleaning fields, and blade cleaning systems suitable for other fields and applications, e.g., cleaning or doctoring systems for metal gravure rollers, inking rollers, paper mill rollers or adhesive applicators, are not normally appropriate.

For electrophotographic purposes, an imaging member having an overcoat layer formed c,n the photosensitive layer is known. The purpose of the overcoat layer is for improving the durability and anti-abrasion properties of the photosensitive layer surface. For instance, U.S. Pat. No. 4,764,448 to Yoshitomi et al., disclose an amorphous silicon imaging member having a specific surface roughness obtained by polishing the surface using soft abrasive substances. The polished surface prevents image blurring in the imaging member.

U.S. Pat. No. 4,904,557 to Kubo, discloses an imaging member comprising a photosensitive layer having a surface roughness of ten points over a reference length of 2.5 mm The particular surface roughness is provided to prevent an interference fringe pattern appearing at image formation, and for preventing black dots from appearing at reversal development.

U.S. Pat. No. 4,537,849 to Arai, discloses a photosensitive element having a roughened selenium-arsenic alloy surface. The outer conductive surface is roughened by direct mechanical grinding (polishing). A roughness of less than or equal to 3 micrometers laterally and from 0.1 to 2 micrometers in height is disclosed for reducing adhesion of transfer paper or toner.

U.S. Pat. Nos. 3,992,091 and 4,076,564 to Fisher, disclose roughened imaging surfaces of a xerographic imaging member. Roughening of the imaging member surface is achieved indirectly by first chemically etching a substrate. The substrate is then uniformly coated with photoconductive material which conforms to the surface in such a way that the substrate roughness is reproduced on a photoconductive surface. The level of roughness may be from 3 to 5 or 10 to 20 micrometers laterally with a 1 to 2 micrometers height.

U.S. Pat. No. 4,134,763 to Fujimura et al., discloses a method for making the surface of a substrate rougher by bringing a grinding stone in light pressure contact with the surface of the substrate, such that small vibrations form a minute roughness on the surface of the substrate. The substrate surface roughness is preferably from 0.3 micrometers to 2 micrometers. The rough surface of the substrate improves adhesion between the substrate and a selenium layer. Unlike the Fisher patents, the roughness of the substrate is not disclosed as being reproduced in the photosensitive layer.

U.S. Pat. No. 4,804,607 to Atsumi, discloses an overcoat layer which is a film-shaped inorganic material overcoating the surface of the photosensitive layer. The overcoat layer is formed such that a rough surface is provided having 500 to 3000 convexities and concavities per 1 centimeter linear distance with a maximum depth difference of .05 to 1.5 micrometers between the convexities and the concavities. The convexities and concavities are formed by heating the support, photosensitive layer and the overcoat layer.

U.S. Pat. No. 4,693,951 to Takasu et al., disclose an image bearing member having a maximum (vertical) surface roughness of 20 micrometers or less, and an average surface roughness which is less than or equal to two times a toner particle size.

U.S. Pat. No. 5,187,039 to Meyer, discloses using an imaging member having a surface roughness which prevents the adhesion of toner particles, especially flat toner particles, during blade cleaning. The surface roughness is defined by:

$$\frac{R}{a_{nn}^2} > \frac{K_B(1-\sigma^2)}{32nEt^2a_f}$$

and $$\frac{R}{a_{nn}^2} > \frac{\sqrt{3}}{8n^2}\ \frac{1+\mu^2}{\mu}\ \frac{K_B}{r}\ \frac{t}{a^f}\ \theta$$

where R is an average height of asperities of the surface, $a_{nn}$ is one-half the nearest neighbor distance between the asperities on the surface, $K_B$ is bulk modulus of the blade, $\sigma$ is Poisson's ratio of the toner composition, E is Young's modulus of tile toner composition, t is an average thickness of flat particles in the toner composition, $a_f$ is an average radius of the flat particles, $\mu$ is an average of toner-blade and toner-surface friction coefficients, $\Gamma$ is the Dupré work of adhesion between the surface and the flat particles, and $\Theta$ is blade tip angle. The particular surface roughness prevents toner particles from developing a high surface energy on the imaging surface.

While the above described imaging members provide a roughened surface for various purposes, the references do not teach or suggest a particular surface texture which would be desirable for preventing the adhesion of toner particles, and in particular, to reduce adhesion between the cleaning blade and the imaging member, thereby extending the cleaning blade's useful life.

SUMMARY OF THE INVENTION

It is thus an object of the invention to efficiently clean the overcoated surface of an imaging member in an electrophotographic apparatus, while significantly reducing the rate at which elastomeric cleaning blades wear out in the process.

It is another object of the invention, to overcome the difficulty with random pattern roughening of the overcoated imaging member surfaces which are more difficult to clean with elastomeric blades since the random features are substantially unrelated to the process direction.

It is still another object of the invention, to form upon the surface of the overcoated imaging member, very fine grooves, parallel to the direction of process movement for the purpose of lessening the effects of adhesion in low to mid volume machines using elastomeric blade cleaners, without degrading electrophotographic copy quality.

The improvement described herein allows the use of previously known blades and overcomes many of the above- described disadvantages of known cleaning blade systems. In particular, it has been found that inscribing, impressing or forming (by known means) very fine parallel grooves into the overcoated surface of an imaging member, the very fine parallel groove pattern running parallel to the direction of process movement, can reduce cleaning blade adhesion without sacrificing cleaning or imaging quality significantly.

Other objects, advantages, and salient features of the invention will become apparent from the detailed description, which, taken in conjunction with the annexed drawings, discloses a preferred embodiment of the invention.

BRIEF DESCRIPTION OF THE DRAWINGS

Referring now to the drawings which form part of this original disclosure.

DETAILED DESCRIPTION OF THE PREFERRED EMBODIMENT

In the following experiment, two sections of elastomeric cleaning blade material were firmly adhered to a shiney, hard, photoreceptor surface with one section adhered by a footprint of one square millimeter in area, the other section adhered by a footprint of one square centimeter in area. If the photoreceptor starts to turn slowly enough, both sections of elastomeric blade material are peeled away from the hard photoreceptor surface without damage. As the adhesion/peeling cycle is repeated at higher and higher rotational speeds, the section in contact over the larger area eventually rips/-tears. This is because, for a constant peeling velocity, the elastomeric blade material deforms until the adhesion is broken. Prior to that, the elongation of the elastomeric material increases until either the adhesion has been broken or the material tears. As soon as the elongation starts, however, peeling starts at one or more borders of the footprint. If the footprint is large, it takes longer for the footprint to become separated. If the footprint is small, peeling reaches the furthest extremities of the footprint before elongation can proceed to an extent equal to that of the larger footprint. Thus, by limiting the areas of individual footprints for contact between the elastomeric blade and the overcoat layer, the risk of tearing the elastomeric blade material, before breaking the footprint adhesions, is lessened.

A preferred embodiment of the imaging member according to the invention will be explained with reference to FIGS. 1-3.

An imaging member 10 provided to rotate in a direction shown by arrow 10*a*. This imaging member 10 has a substrate 12, a photo-sensitive layer 14 formed on the substrate 12, and an overcoat layer 16 formed on the photosensitive layer 14 as shown in the vertical sectional view of FIG. 1. Importantly, the invention is equally applicable to either belt-type or dip-coated drum imaging members.

Figure 1:
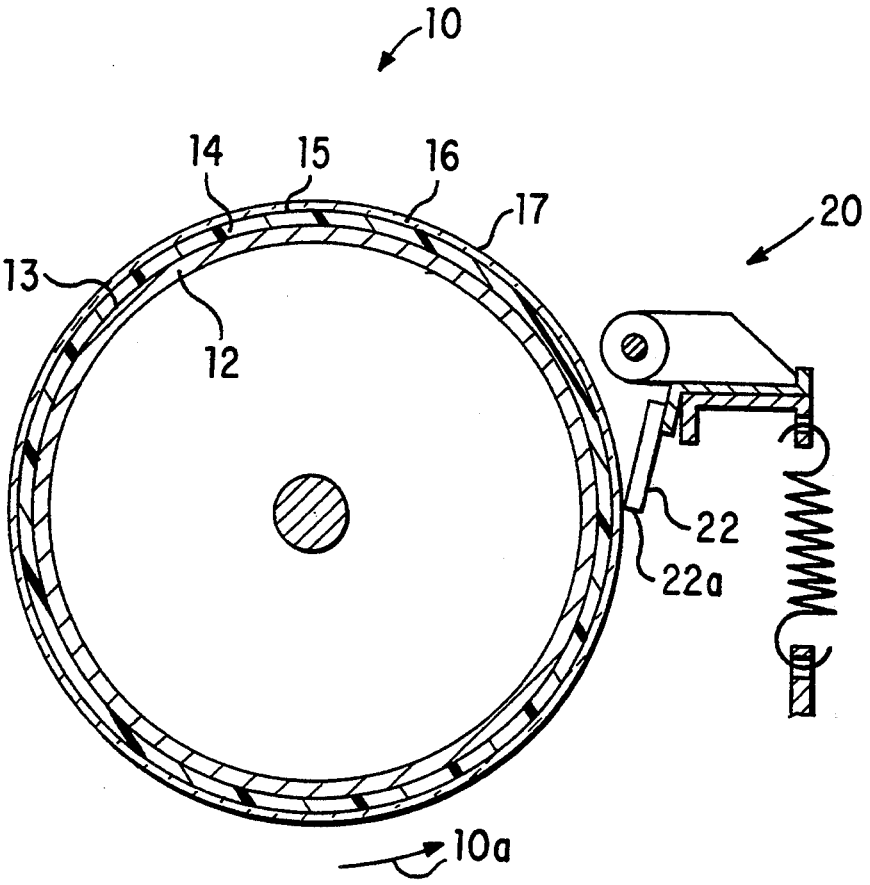
FIG. 1 is a partial cross-sectional side view of an exemplary blade cleaning system, in accordance with the invention.
Figure 2:
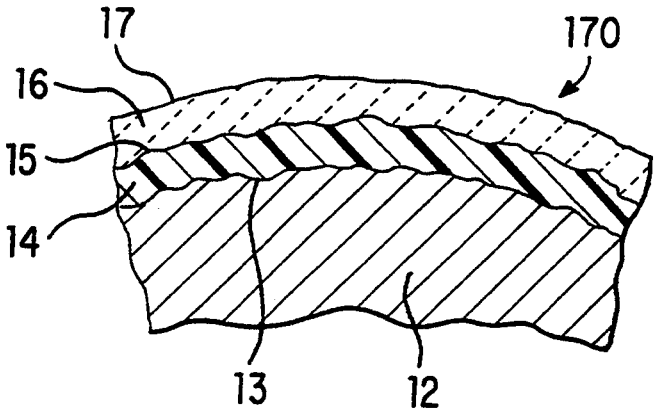
FIG. 2 is a magnified cross-sectional side view of a portion of the overcoated imaging member of FIG. 1, in accordance with the invention.

As shown in FIG. 1, the surface of the overcoat layer 16 is in contact with a cleaning device 20 for removing residual toner from the surface of the imaging member. Specifically, an elastomeric cleaning blade 22 is mounted such that the blade edge 22*a* is in opposed relationship to the surface 17 of the overcoat layer 16. In such an arrangement, the cleaning blade's 22 beam deflection provides the force required to clean the surface 17.

For the substrate 12 and the photosensitive layer 14 according to the invention, the conventional substrate and photosensitive layer may be used.

The substrate 12 is a conductive cylinder shaped component, for instance, a cylindrical component made of aluminum.

The photosensitive layer 14 is the layer having the photosensitivity, and is formed on the periphery surface of the substrate 12. Organic materials or inorganic materials may be used for the photosensitive layer 14. In this preferred embodiment, the photosensitive layer 14 is formed on the surface 13 of substrate 12 by using an organic photosensitive resin.

The overcoat layer 16 is formed on the surface 15 of the photosensitive layer 14, and is a film-shaped inorganic material coating the surface 15 of the photosensitive layer 14. Silicon oxide (SiO), silicon dioxide ($SiO_2$), titanium oxide ($TiO_2$), aluminum oxide ($Al_2O_3$) and silicon carbide (SiC) may be used for the inorganic material. The overcoat layer 16 is formed on the surface 15 of the photosensitive layer 14 by a known technique such as vacuum evaporation using the inorganic material.

The invention then, is characterized in that the surface 17 of the overcoat layer 16 is formed such that a pattern of at least 20 parallel grooves 170 per centimeter are impressed (by known means such as inscribing, etching or other mechanical/chemical scratching technique) laterally upon the overcoat layer 16 in a uniform pattern, such that the parallel grooves 170 are disposed parallel to a process direction 10*a* and extend along an entire circumference of the imaging member 10. As discussed above, a cleaning blade 22 is provided for deformably engaging the imaging member 10 to remove residual toner material therefrom. The parallel groove 170 pattern reduces adhesion between the cleaning blade 22 and the imaging member 10 without degrading image reproduction quality.

Importantly, different electrophotographic processes use different toner particle sizes and charges. Thus, the parallel grooves 170 described above preferably have a depth and lateral width per groove sufficiently small to prevent toner particles from lodging within the grooves 170. That is, the parallel grooves 170 should be dimensioned smaller than the dimensions of the smallest toner particles envisioned for use with the preferred electrophotographic system. Further, the cleaning blade 22 is preferably elastomeric with the blade hardness and loading parameters appropriately tailored for intended use.

In another aspect of the invention, a method for making the imaging member 10 with an imaging surface 17 with improved cleaning blade 22 cleanability, comprising the following steps. A smooth conductive substrate 12 is provided. The substrate 12 is overcoated with a thin and uniform layer of photosensitive material 14. Next, an organic material is evaporated in a vacuum to form an overcoat layer 16 on the photosensitive layer 14. Formed laterally (by known means as discussed above) across the overcoat layer 16 is a uniform pattern of at least 20 parallel grooves 170 per centimeter. These grooves 170 are arranged to be parallel to a process direction 10*a* and to extend along the entire circumference of the imaging member 10, thereby causing a reduction in adhesion between the cleaning blade 22 cleaning edge 22*a* and the surface 17 of the overcoat layer 16 without degrading image reproduction quality.

Figure 3:
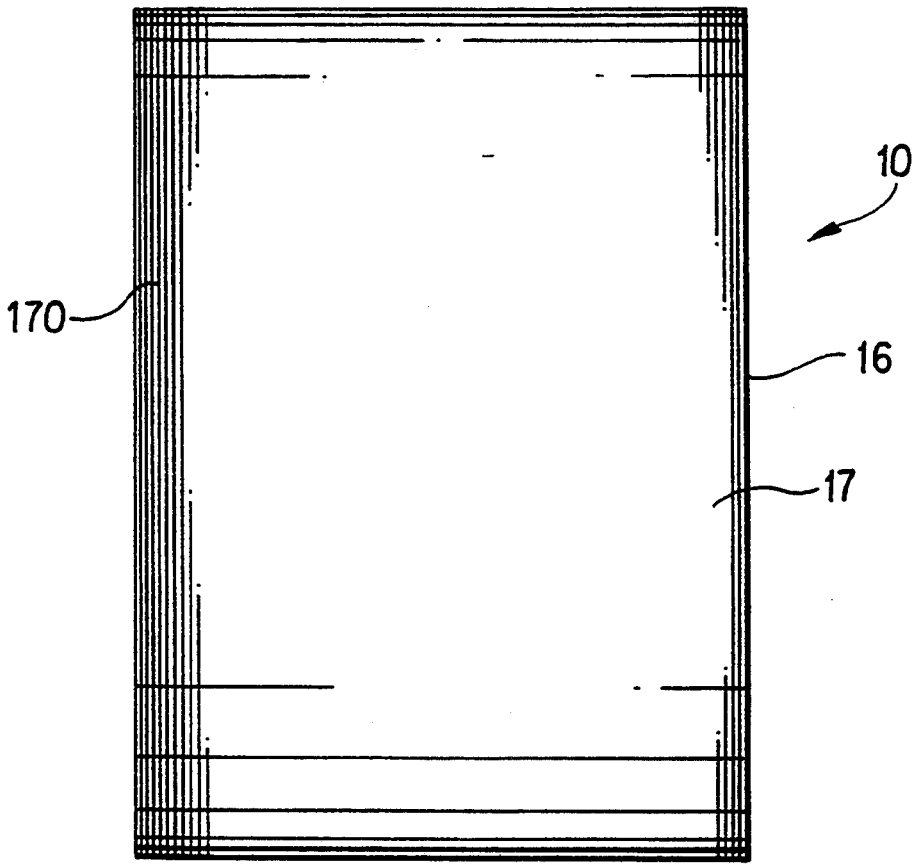
FIG. 3 depicts a sample imaging member with the overcoat layer textured in accordance with the invention.

Shown in FIG. 3 is a depiction of a representative overcoated imaging member inscribed or textured in accordance with the inventive process described above. After extensive testing, sample cleaning blade wear was many times less than that encountered with specularly shiney overcoated imaging members. Thus, the pattern of very fine grooves 170, parallel to the direction of process movement, lessens the effects of wear on the elastomeric cleaning blade materials tested and yet, the grooves 170 do not effect copy quality.

It is proposed herein that the reduced blade wear is a direct result of the very fine groove pattern breaking up the footprint of contact between a given region of blade-tuck and the overcoated imaging member. This serves to limit the width of a given tuck (width perpendicular to the process direction), thereby limiting the process direction degree of tuck. In other words, the impressed pattern of very fine grooves stabilizes the degree of blade-tuck to that sufficient for cleaning, and well below the level of blade-tuck induced wear when no such grooves exist on the overcoated imaging member surface.

While the invention has been described in connection with the preferred embodiments, it will be understood that it is not intended to limit the invention to these embodiments. On the contrary, it is intended to cover all alternatives, modifications and equivalents as may be included within the spirit and scope of the invention as defined by the appended claims.

What is claimed is:

1. An electrophotographic image reproducing apparatus that uses toner material comprising at least:

an imaging member having at least one photosensitive layer and an overcoat layer formed on said photosensitive layer, wherein said overcoat layer has a pattern of parallel grooves formed laterally upon said overcoat layer in a uniform pattern, such that said parallel grooves are disposed parallel to a process direction and extend along a circumference of said imaging member; and a cleaning blade for deformably engaging said imaging member to remove said toner material therefrom, wherein said parallel groove pattern reduces friction between said cleaning blade and said imaging member without degrading image reproduction quality.

2. The apparatus of claim 1, wherein said pattern of parallel grooves comprises at least 20 parallel grooves per centimeter.

3. The apparatus of claim 1, wherein said grooves have a predetermined depth sufficiently shallow to prevent individual particles of said toner material from lodging in said grooves.

4. The apparatus of claim 3, wherein said grooves have a predetermined lateral width sufficiently narrow to prevent individual particles of said toner material from lodging in said grooves.

5. The apparatus of claim 1, wherein said cleaning blade is elastomeric.

6. A method for making an imaging member with an imaging surface with improved cleaning blade cleanability, comprising the steps of:

providing a smooth conductive substrate;

overcoating said substrate with a thin and uniform layer of photosensitive material;

evaporating an inorganic material in a vacuum to form an overcoat layer on said photosensitive layer; and forming laterally across said overcoat layer a uniform pattern of parallel grooves such that said parallel grooves are disposed parallel to a process direction and extend along a circumference of said imaging member to cause a reduction in friction between said cleaning blade and said imaging surface without degrading image reproduction quality.

7. The method of claim 6, wherein said forming step further comprises at least 20 parallel grooves per centimeter.

* * * * *